US005804918A

United States Patent [19]

Yazawa et al.

[11] Patent Number: 5,804,918

[45] **Date of Patent: *Sep. 8, 1998**

[54] ELECTROLUMINESCENT DEVICE HAVING A LIGHT REFLECTING FILM ONLY AT LOCATIONS CORRESPONDING TO LIGHT EMITTING REGIONS

[75] Inventors: Mika Yazawa, Obu; Tomohiro Yonekawa, Anjo; Yutaka Hattori, Okazaki; Nobuei Ito, Chiryu; Tadashi Hattori, Okazaki, all of Japan

[73] Assignee: Nippondenso Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 568,617

[22] Filed: Dec. 7, 1995

[30] Foreign Application Priority Data

Dec. 8, 1994 [JP] Japan ..... 6-331702
Sep. 6, 1995 [JP] Japan ..... 7-255634

[51] Int. Cl.[6] ..... H01J 1/62; H01J 63/04; H01J 17/49

[52] U.S. Cl. ..... 313/506; 313/509; 313/586; 313/587; 313/110

[58] Field of Search ..... 313/498, 501, 313/502, 506, 509, 512, 587, 110, 112, 113; 428/917; 250/462

[56] References Cited

U.S. PATENT DOCUMENTS

| | | | |
|---|---|---|---|
| 2,730,644 | 1/1956 | Michlin | 313/498 |
| 3,869,195 | 3/1975 | Aldrich et al. . | |
| 4,237,381 | 12/1980 | Schroeder | 250/462 |
| 4,482,580 | 11/1984 | Emmett et al. | 313/502 X |
| 4,734,618 | 3/1988 | Matsudaira et al. | 313/498 X |
| 4,803,402 | 2/1989 | Raber et al. | 313/587 X |
| 5,036,249 | 7/1991 | Pike-Biegunski et al. | 313/509 |
| 5,072,152 | 12/1991 | Tuenge et al. | 313/509 |
| 5,188,901 | 2/1993 | Shimizu | 313/512 X |
| 5,220,183 | 6/1993 | Taniguchi et al. . | |
| 5,315,491 | 5/1994 | Spencer et al. | 313/512 X |

FOREIGN PATENT DOCUMENTS 3-69899 7/1991 Japan .

*Primary Examiner*—Sandra L. O'Shea
*Assistant Examiner*—Mark Haynes
*Attorney, Agent, or Firm*—Cushman Darby & Cushman Intellectual Property Group of Pillsbury Madison & Sutro, LLP

[57] ABSTRACT

An electroluminescent device comprises an insulating substrate having thereon a pair of electrodes comprising a transparent first electrode and a transparent second electrode, with a stack of transparent first insulating layer, a luminescent layer, and a second transparent layer interposed therebetween; provided that a light reflecting plane is formed on the outside of one of the electrode pairs with a transparent insulating substance interposed between, the electrode being disposed opposed to the light outcoupling direction.

12 Claims, 6 Drawing Sheets

ELECTROLUMINESCENT DEVICE HAVING A LIGHT REFLECTING FILM ONLY AT LOCATIONS CORRESPONDING TO LIGHT EMITTING REGIONS

CROSS REFERENCE TO RELATED APPLICATION

This application is based upon and claims the benefit of priority of the prior Japanese Patent applications No. 6-331702 filed on Dec. 8, 1994 and No. 7-255634 filed on Sep. 6, 1995, the contents of which are incorporated herein by reference.

BACKGROUND OF THE INVENTION

1. Field of the Invention

The present invention relates to an electroluminescent (EL) device for use in instruments as a segment or a matrix display device of an emissive type, in displays and the like of various types of information terminals, etc.

2. Related Arts

Electroluminescent devices known heretofore comprise a luminescent layer based on a compound of an element belonging to Group II of periodic table with that of Group VI (referred to simply hereinafter as "a Group II–VI compound") such as zinc sulfide (ZnS) or strontium sulfide (SrS) doped with an element which functions as a luminescent center. Those devices are based on the luminescent phenomenon which occurs when an electric field is applied to the luminescent layer, and are believed promising as components of a flat panel display of an emissive type.

In an EL device having a structure of a conventional type, however, the light emitted from the luminescent layer proceeds in various directions that only a part of the total emission is obtained in the light outcoupling direction. Accordingly, to increase the insufficiently low emission luminance, various proposals are made to effectively utilize the emitted light. For instance, the luminance in the light outcoupling direction can be increased by using a metallic electrode layer comprising a metal having a high reflectance, such as aluminum (Al), as the material for the electrode disposed opposed to the light outcoupling direction of the EL device in order to apply the electric field. The luminance can be increased by employing this constitution, because the light advanced in the direction opposed to the light outcoupling direction can be reflected back to the light outcoupling direction. Also proposed is to increase the reflection intensity by employing a constitution comprising a multiple reflection film formed between the electrodes (see, for example, an unexamined published Japanese Utility Model application Hei3-69899).

It can be seen from the foregoing that the luminance of an EL device is increased preferably by reflecting back and fully utilizing the radiant light. In practice, this can be achieved by using a metallic reflection plane or a multiple reflection film having a laminated structure. Furthermore, in case of forming a multi-color or full-color EL panel by disposing a plurality of EL devices opposed to each other, the light reflecting plane must be placed, as viewed from the light outcoupling side, at the back of the luminescent layer of the EL device located at the rear side.

However, even if the reflectance is high, a metallic electrode cannot be used substantially for the electrode constituting the EL device. In an EL device, a sufficiently high voltage must be applied to the luminescent layer to generate the emission. This requires a high electric field to be applied to the electrodes. If a metallic electrode such as an aluminum (Al) electrode is used, voids generate due to migration. Furthermore, a metallic electrode such as aluminum is readily to invite hillocks due to the heat applied during the process of device fabrication. Thus, degradation occurs acceleratingly on a metallic electrode when compared with other electrodes made of ITO (indium tin oxide) and the like.

Moreover, in case a metallic electrode is used, the destruction occurs in a propagation mode. This is in contrast with the self-repairing type destruction mode observed in the conventional transparent electrodes, and this spreads the breakage over the entire pixel. Thus, in a dot matrix display, for instance, the breakage may be propagated to form a line defect and considerably impair the display quality.

In case a multiple reflection film is formed between the electrodes, the reflection can be effected in the vicinity of the luminescent layer. Accordingly, image blurring due to double or triple reflection of image can be prevented from occurring. However, because a multiple reflection film is interposed between the electrodes, the electric field applied to the luminescent layer decreases. Thus, to obtain a light emission equivalent to that free of reflecting layers, a further higher voltage must be applied to the pair of electrodes. This unfavorably brings about problems for the EL device, such as an increased power consumption.

SUMMARY OF THE INVENTION

An object of the present invention is to provide an EL device improved in luminance, yet without impairing the display quality and without increasing the applied voltage.

The present invention provides an EL device comprising an insulating substrate having thereon a pair of electrodes comprising a transparent first electrode and a transparent second electrode, with a stack of transparent first insulating layer, a luminescent layer, and a second insulating layer interposed therebetween as an electroluminescent element, provided that a light reflecting plane is formed on the outside of one of the electrode pairs with a transparent insulating substance interposed therebetween, the electrode being disposed opposed to the light outcoupling direction.

BRIEF DESCRIPTION OF THE DRAWINGS

These and other objects, features and characteristics of the present invention will be appreciated from a study of the following detailed description, the appended claims, and drawings, all of which form a part of this application. In the drawings:

DETAILED DESCRIPTION OF THE PRESENTLY PREFERRED EXEMPLARY EMBODIMENTS

Figure 1:
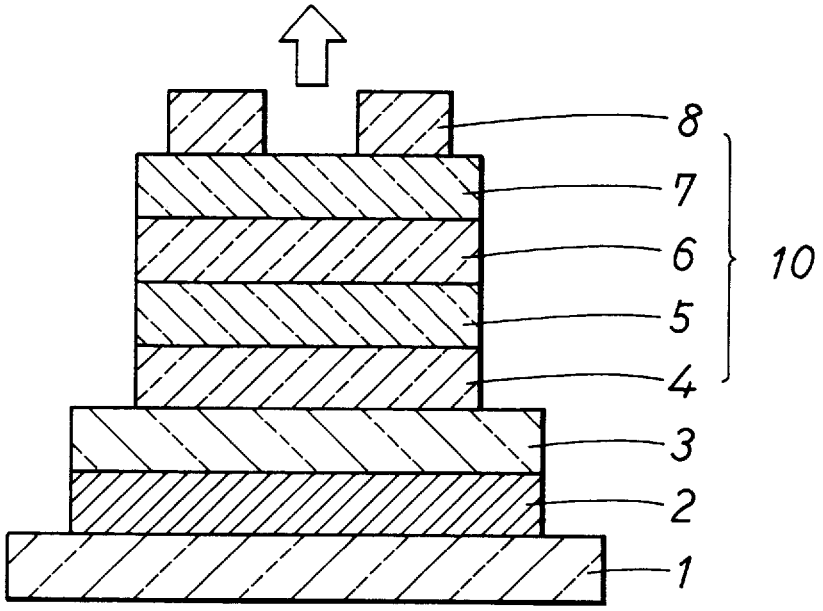
FIG. 1 is a schematic cross-sectional view of an EL device according to a first embodiment of the present invention.

According to an aspect of the present invention, an EL device includes an EL element portion comprising a transparent first electrode, a transparent second electrode, both of which makes up a pair of electrodes, and a stack of a transparent first insulating layer, a luminescent layer, and a transparent second insulating layer interposed between the electrode pairs; and a light reflecting plane provided on the outside of one of the electrode pairs with a transparent insulating substance interposed therebetween, the electrode being disposed opposed to the light outcoupling direction of the EL element portion.

More specifically, the constitution above can be provided by forming a light reflecting plane on the surface of an insulating substrate, and after forming an insulating substance on the light reflecting plane, placing the EL element portion thereon. In this case, the insulating substance is preferably provided at a thickness of between 0.01 $\mu$m and 5 $\mu$m. According to this, the layer of the insulating substance is formed thinly. Thus, the light reflecting plane can be formed in the vicinity of the EL element portion, and hence a display free of double image can be obtained.

Furthermore, the constitution above can be provided by disposing the EL element portion on an insulating substrate, and utilizing the insulating substrate as the insulating substance in such a manner that a light reflecting plane is provided on the side of the insulating substrate opposed to the side having thereon the EL element portion. In this case, the insulating substrate can be formed at a thinness achievable by the present fabrication level, but not thicker than 100 $\mu$m.

That is to say, the light reflecting plane may be formed in either side of the insulating substrate. Even in case the light reflecting plane is formed on the back of the insulating substrate, a multiple image can be prevented from being formed by providing the insulating substrate at a thickness as thin as 100 $\mu$m or less.

If the transparent first electrode, i.e., the electrode nearer to the insulating substrate of the pair electrodes, is patterned as desired in such a manner that the patterned regions are each insulated and isolated from each other in either of the constitutions above, the light reflecting plane is preferably patterned in such a manner that the patterned portions are each insulated and isolated from each other and that each patterned portion corresponds to the plurality of patterned regions of the transparent first electrode. In this case, the pattern of the light reflecting plane is preferably patterned in the same pattern as that of the transparent first electrode, or in a slightly smaller pattern similar to that of the transparent first electrode.

Furthermore, the light reflecting plane is preferably placed in correspondence with the light emitting region in which the transparent first electrode and the transparent second electrode are superposed, or placed inside the corresponding region.

The insulating substance can be formed as a monolayer of the insulating material or a multilayered film comprising a plurality of different types of insulating materials. As the insulating material, any material selected from the group consisting of SiON, SiN, $SiO_2$, $Ta_2O_5$, and $Al_2O_3$ can be used.

For the light reflecting plane, a metallic plane having a reflectance of 50% or higher can be used. For instance, a metal selected from the group consisting of aluminum (Al), silver (Ag), copper (Cu), gold (Au), nickel (Ni), tantalum (Ta), tungsten (W), molybdenum (Mo), and an aluminum (Al) alloy containing Al as the principal component thereof can be used.

The aluminum (Al) alloy suppresses the formation of hillocks on aluminum-based metallic reflecting plane. Although the light reflecting plane is provided outside the device, a large hillock induces a drop in withstand voltage of the device. Accordingly, the use of aluminum in the form of an aluminum alloy is effective for increasing the withstand voltage of the device. Furthermore, when the metallic film of aluminum or an aluminum alloy for use as the light reflecting plane is formed at a thickness of between 100 Å and 1,000 Å, the formation of hillocks in aluminum and aluminum alloys can be further suppressed while maintaining high reflectance. In other words, maintaining high reflectance of 50% or higher needs the metallic film of aluminum or an aluminum alloy for use as the light reflecting plane formed at a thickness of 100 Å or more, and in order to suppress the formation of hillocks or voids, which decreases the withstand voltage of the device, the film thickness of the metallic film needs setting to be 1,000 Å or less.

Metallic films made of, for example, aluminum (Al), silver (Ag), copper (Cu), gold (Au), nickel (Ni), tantalum (Ta), tungsten (W), or molybdenum (Mo) yield a high reflectance and are therefore suitable for increasing the luminance of the EL device. Thus, even if the light reflecting plane is provided with a thin layer of an insulating substance formed on the outer side of the transparent electrode, the luminance can be improved without forming a multiple image so long as the layer of the insulating substance is formed sufficiently thin at a thickness of, for instance, 5 $\mu$m or less. The insulating substance can be provided by a monolayer of an insulator, or by a multilayer comprising a plurality of types of insulators, the material of which has no influence on the metallic material constituting the light reflecting layer. As described above, a conventionally used stable insulating material such as SiON, SiN, $SiO_2$, $Ta_2O_5$, or $Al_2O_3$, which can be easily formed, can be used as the insulating substance.

Furthermore, the light can be reflected by utilizing a reflection enhancing film which takes advantage of the interference of a lower refractive index insulating layer and a higher refractive index insulating layer. That is, an insulating layer having a refractive index higher than that of the insulating substance can be disposed on the outer side of the insulating substance to provide the light reflecting plane. In other words, the light reflecting plane may be a reflection enhancing film comprising a stacked film in which a lower refractive index transparent insulating layer and a higher refractive index transparent insulating layer are sequentially laminated. Furthermore, the light reflecting plane may be a semitransparent film which reflects the light emitted from the luminescent layer alone while the other components of light differing in wavelength are transmitted.

In case the light reflecting plane is made of a substance capable of forming an anodic oxidation film, the anodic oxide film can be used as the insulating substance. As a matter of course, a monolayer of an insulating film or a multilayered film comprising a plurality of types of insulating films can be used together with the anodic oxide film. When a metallic film capable of forming an anodic oxidation film is used as the light reflecting plane, the layer of the insulating substance is formed after surface treating the metallic light reflecting plane. Thus, a layer of the insulating substance can be formed easily while maintaining the mirror plane.

As the EL element portion, a well-known constitution can be used. For instance, the EL element portion comprises a transparent first electrode made of an ITO transparent conductive film, a transparent first insulating layer formed of transparent tantalum pentoxide ($Ta_2O_5$) and the like, a luminescent layer whose host material is of zinc sulfide (ZnS), a transparent second insulating layer and a transparent second electrode made of a zinc oxide ($ZnO:Ga_2O_3$) transparent conductive film. Furthermore, the color of the luminescence emitted therefrom can be variously changed according to the type of luminescent center element incorporated into the luminescent layer. For example, the EL element portion emits an amber color by adding manganese (Mn) to the luminescent layer with ZnS used as the host material thereof, and emits green, red, blue, and white colors by respectively adding terbium fluoride ($TbF_3$), samarium chloride ($SmCl_3$), thulium chloride ($TmCl_3$), and praseodymium fluoride ($PrF_3$).

As described in the foregoing, a metallic material having high reflectance but not allowed to use as a metallic electrode in conventional EL devices is utilized in the EL device according to the present invention by interposing an insulating substance between the metallic material and the electrode, thereby forming the metallic material without bringing it into electric contact with the electrode. Thus, the present invention is effective for sufficiently increasing the emission luminance. It should be noted, however, that the insulating substance is formed at a thickness of 0.01 $\mu$m or thicker. If the insulating substance is provided thinner than the defined thickness, hardly any effect can be achieved.

The process of forming the light reflecting plane on the substrate can be performed independent to the process of forming the EL element portion by providing the light reflecting plane on the side opposed to that on which the EL element portion is provided.

If the light reflecting plane is formed by using a metallic film and in such a manner that the light reflecting plane portions are provided in correspondence with the light emitting regions of the EL element, the plurality of regions in the transparent first electrode separated and isolated from each other can each maintain their own potential differing from each other. That is, current leakage in the plurality of regions can be prevented from occurring, and thereby the regions can maintain the potentials differing from each other. Even if the film thickness of the insulating substance is decreased, the formation of short circuit in the transparent first electrode interconnection via the metallic film constituting the light reflecting film can be avoided. This results in a low cost fabrication of the EL devices. In particular, by patterning the light reflecting plane in such a manner that the pattern corresponds with that of the light emitting regions, or in such a manner that the patterned portions be smaller than those light emitting regions, the contrast of light emission can be improved.

The present invention is described in further detail below referring to specific examples.

EXAMPLE 1

FIG. 1 is a schematically shown cross section view of an EL device according to a first embodiment of the present invention. Referring to FIG. 1, a metallic film making up a light reflecting plane 2 is formed on a glass substrate 1 provided as the insulating substrate, and an insulating substance 3 is formed on the light reflecting plane 2. A well known EL element structure comprising a first electrode 4, a first insulating layer 5, a luminescent layer 6, a second insulating layer 7, and a second electrode 8 is formed on the insulating substance 3. The layer of the insulating substance is formed at a thickness of 5 $\mu$m or less to electrically isolate and separate the light reflecting plane 2 from the first electrode 4. The light reflecting plane 2 can be formed simply and free of patterning, but the transparent insulating substance is preferably a pinhole-free dense film that is deposited by ALE (atomic layer epitaxy), CVD (chemical vapor deposition), etc. The light outcoupling direction of the EL device is indicated with an arrow in the figure.

The light radiated from the luminescent layer 6 advances upward and downward. The light which advances downward passes through the transparent first electrode 4 and the transparent layer of the insulating substance 3, and is almost reflected by the light reflecting plane 2. The light thus reflected passes upward the layer of the insulating substance 3 and the first electrode 4 again. Thus, it can be seen that the luminance can be almost doubled, because it results not only from the light which was emitted upward, but also from the light which once advanced downward and reflected upward.

Because the layer of the insulating substance 3 is formed thinly (at a thickness of 1 $\mu$m in this case), it is unlikely that a blurred image forms due to the difference between the light directly emitted upward from the luminescent layer 6 and the light reflected by the light reflecting plane 2. In general, people allow a mismatch up to 100 $\mu$m without feeling it uncomfortable. This applies to the case of an light reflecting plane, and hence, no problem is found so long as the layer of the insulating substance 3 is provided at a thickness of 5 $\mu$m or less.

EXAMPLE 2

Figure 2:
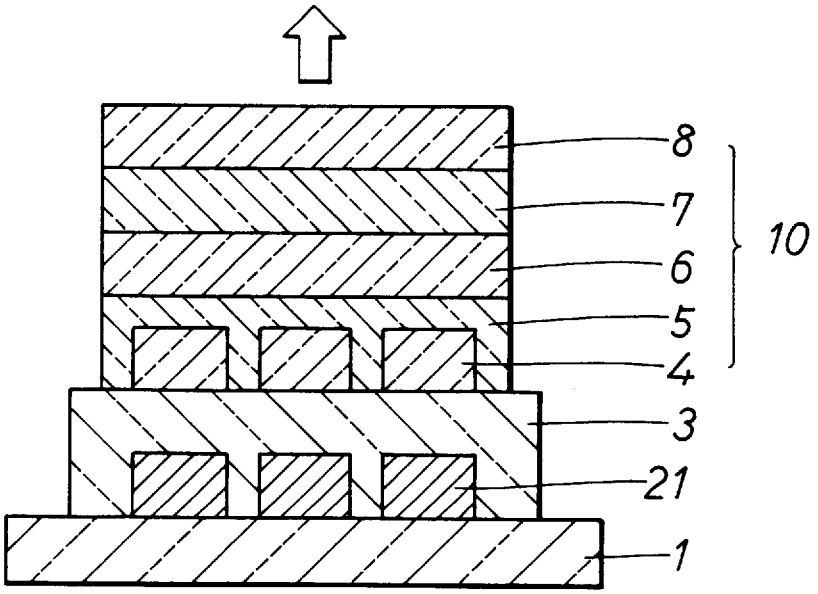
FIG. 2 is a schematic cross-sectional view of an EL device according to a second embodiment of the present invention.
Figure 3:
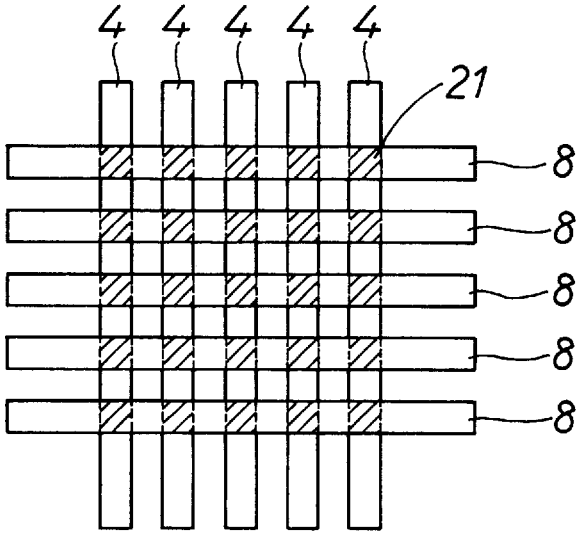
FIG. 3 is a schematic view showing a planar pattern depicting the positional relationship between the electrodes and the light reflecting plane of the EL device of the second embodiment according to the present invention.

The EL device according to the second embodiment of the present invention is characterized by the structure of the light reflecting plane 21. Referring to FIG. 2, the EL device comprises a light reflecting plane 21 made from a thin film Al alloy formed on a glass substrate 1. The EL device is of a dot matrix type comprising a transparent first electrode 4 and a transparent second electrode 8 each formed in the form of a plurality lines and crossed with each other. As shown in FIG. 3, the portions in which the transparent first electrode 4 and the transparent second electrode 8 are superposed provide the light emitting regions. In the present example, the light reflecting planes 21 are shown with hatched portions in FIG. 3, and are formed in correspondence with the light emitting regions.

Referring to FIG. 2, an insulating substance 3 is formed on the glass substrate 1 in such a manner that the light reflecting plane 21 is thereby covered. An EL element 10 similar to that described in Example 1 is formed on the insulating substance 3. As shown in FIG. 3, the regions of the light reflecting planes 21 that are present just under the plurality of linearly formed transparent first electrodes 4 are insulated and isolated from each other. Thus, no current leakage occurs among the plurality of linearly formed transparent first electrodes 4 via the light reflecting plane 21. Thus, the film thickness of the insulating substance 3 can be decreased to reduce the fabrication cost. Furthermore, because the light reflecting planes 21 are present only under the light emitting regions, no light reflection occurs between lines of transparent first electrode 4 as well as between lines of transparent second electrode 8. The contrast of the display image can be thereby increased.

Figure 4:
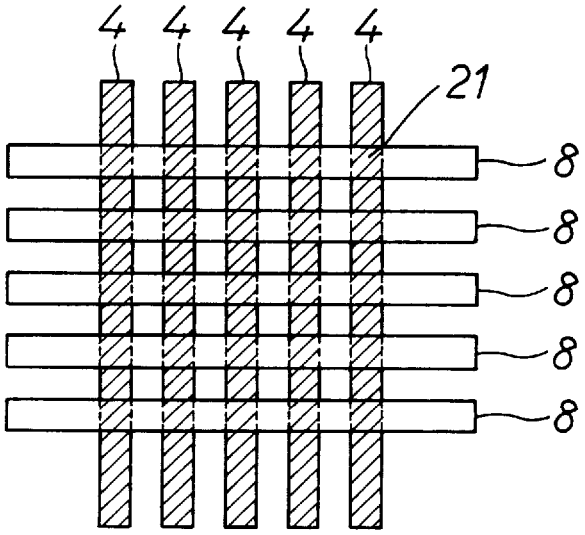
FIG. 4 is a schematic view showing another planar pattern depicting the positional relationship between the electrodes and the light reflecting plane of the EL device of the second embodiment according to the present invention.

Instead of forming the light reflecting planes 21 in correspondence with the light emitting regions, they may be formed slightly smaller than the light emitting regions and in a shape similar thereto. Furthermore, as shown in FIG. 4, the light reflecting planes 21 may be formed in the same pattern as that of the transparent first electrodes 4. In this case, the surface irregularity of the insulating substance 3 can be reduced, and therefore step coverage for the overlying films making up the EL element structure is improved. That is, by forming the light reflecting planes 21 in the same pattern as that of the transparent first electrodes 4, the surface of the insulating substance 3 approximates flat, films making up the EL element structure also approximate flat, and therefore the destruction due to the irregularities existing in the EL element structure can be suppressed. Of course, the light reflecting planes 21 having the same pattern as that of the transparent first electrode 4 may be formed slightly smaller than the electrodes 4.

According to the Example 2, the insulating substance 3 may be a film which can be easily deposited by means of sputtering and the like, and it may contain pinholes. This is allowed, because, in case of etching the transparent first electrode 4 into a desired pattern, the etching solution in the etching region of the transparent first electrode 4 permeates deeper to the base film side through the pinholes that are present in the insulating substance 3. However, since the light reflecting planes 21 are already formed by patterning, no light reflecting plane 21 is present in the region where the permeating etching solution reaches. Accordingly, the patterned light reflecting planes 21 remain without being etched, and the light reflecting planes 21 can be obtained free of holes. A superior display image can be thereby obtained without being impaired. Moreover, the peeling off of the EL element structure 10 due to the dissolution of the light reflecting planes 21 can be prevented from occurring. In particular, in case the light reflecting planes 21 are formed slightly smaller than the light emitting regions or the transparent first electrodes 4, the effect preventing the patterned light reflecting planes 21 from being etched is remarkably obtained.

In case aluminum is used for the light reflecting planes 21, hillocks and voids may form in the later steps of forming the EL element. Although the light reflecting planes 21 are formed outside of the EL element, the withstand voltage decreases, and, in some cases, the fine holes in the light reflecting planes 21 impair the appearance of the display. To prevent these unfavorable phenomena from occurring, foreign elements such as Si, Cu. Ti, B, Hf, Mg, Fe, Cr, Mn, or Zn are added to form an alloyed aluminum. In this manner, hillocks and voids can be prevented from developing, thereby increasing the withstand voltage and removing fine holes from the light reflecting planes 21. In an EL device, it is preferred to use an Al alloy in which trace quantity of Mg, Fe, Cr, Si, Cu, Mn, or Zn is added.

The Al or the Al alloy is preferably provided as thin as possible to prevent hillock from generating. By controlling the film thickness to be 1,000 Å or less but 100 Å or more, a highly reliable device maintaining its high reflectance can be obtained.

In the Example 2, the EL device is of a dot matrix type, but a segment type is also applicable. In this case, the light reflecting planes 21 are so disposed as to correspond to each light emitting segment.

EXAMPLE 3

Figure 5:
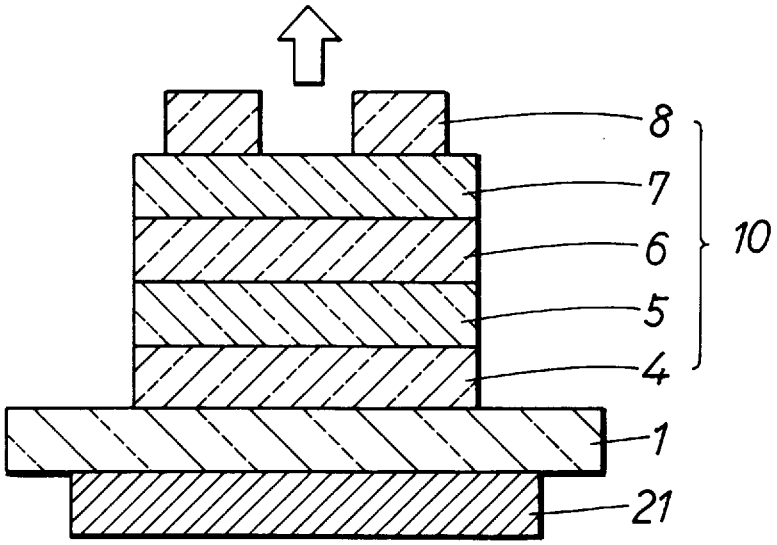
FIG. 5 is a schematic cross-sectional view of an EL device according to a third embodiment of the present invention.

Referring to FIG. 5, the EL device comprises a light reflecting plane 21 formed on a glass substrate 1 provided as the insulating substrate, but on a side opposite to that on which the EL element 10 is formed. The EL element 10 may be of a known structure. The glass substrate 1 is provided at a thickness of 100 $\mu$m or less. Also in this case, the light which proceeds downward from the luminescent layer 6 is transmitted through the transparent first electrode 4 and the glass substrate 1, and is reflected by the light reflecting plane 21 to be emitted upward from the light outcoupling side.

Because the glass substrate 1 is provided at a thickness of 100 $\mu$m or less, double image and the like that is induced by the reflected light can be neglected. Since a glass substrate loses its mechanical strength with decreasing thickness to 100 $\mu$m or less, a strong and transparent substrate such as of sapphire or diamond may be used in the place of the glass substrate.

A glass substrate can be fabricated sufficiently thinly, and one with a thickness of about 100 $\mu$m is readily available. In practice, however, glass loses its mechanical strength for use as a substrate with decreasing thickness. Thus, it should have a minimum thickness available by fabrication, preferably, a thickness of about 50 $\mu$m or more, and a casing and the like is provided as a support. In the present constitution, the layer of the insulating substance as described in Example 1 provides the glass substrate 1. In fact, the glass substrate is preferably as thin as possible.

Figure 6:
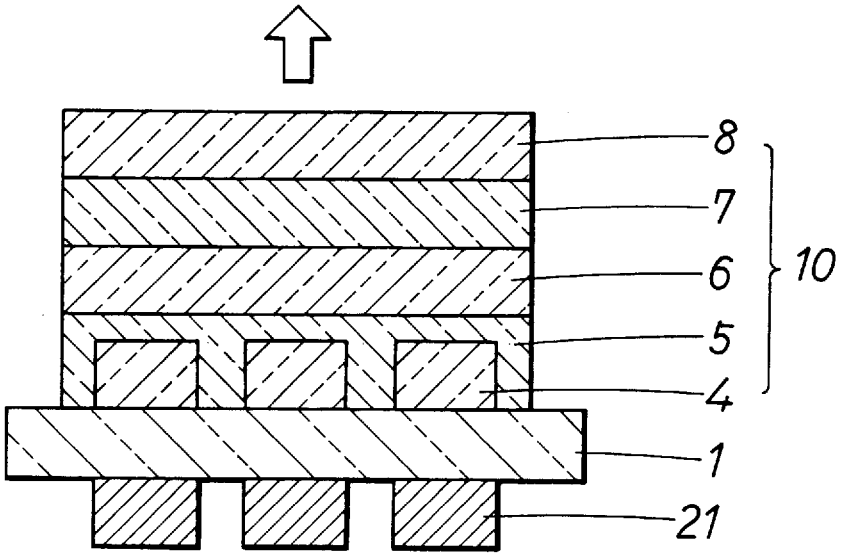
FIG. 6 is a schematic cross-sectional view of an EL device according to an application of the third embodiment.
Figure 7:
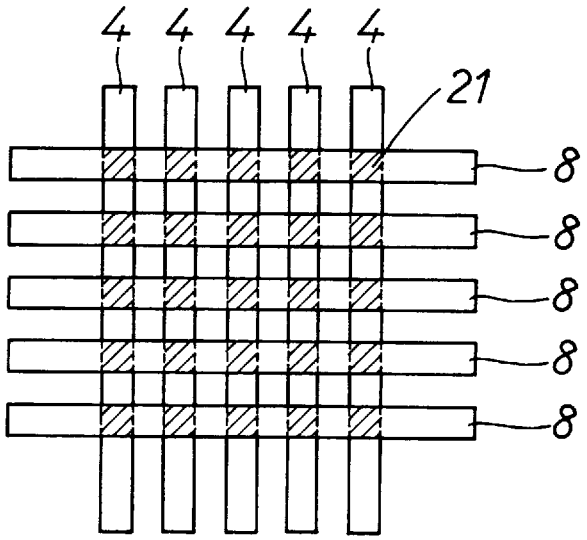
FIG. 7 is a schematic view showing a planar pattern depicting the positional relationship between the electrodes and the light reflecting plane of the EL device shown in FIG. 6.

The light reflecting plane 21 in the present constitution is deposited on the entire surface of the substrate, however, it may be formed only on the substrate corresponding to the light emitting regions as shown in FIGS. 6 and 7, or may be formed in the same pattern as that of the transparent first electrode 4. In this manner, the contrast of the display image can be increased, because the light reflection among the lines of the transparent first electrode 4 and the transparent second electrode 8 can be eliminated, i.e., unfavorable light reflection in the portion other than the light emitting regions can be avoided.

Considering the fabrication process, the light reflecting plane 21 is formed on the back of the glass substrate 1 in the final process step after forming the EL element 10 on the glass substrate 1. In this manner, the light reflecting plane 21 can be formed separately from the process for fabricating the EL element. Accordingly, the light reflecting plane 21 can be formed in any other circumstance in which an EL element having a structure differing from that shown in the figure is employed.

EXAMPLE 4

Figure 8:
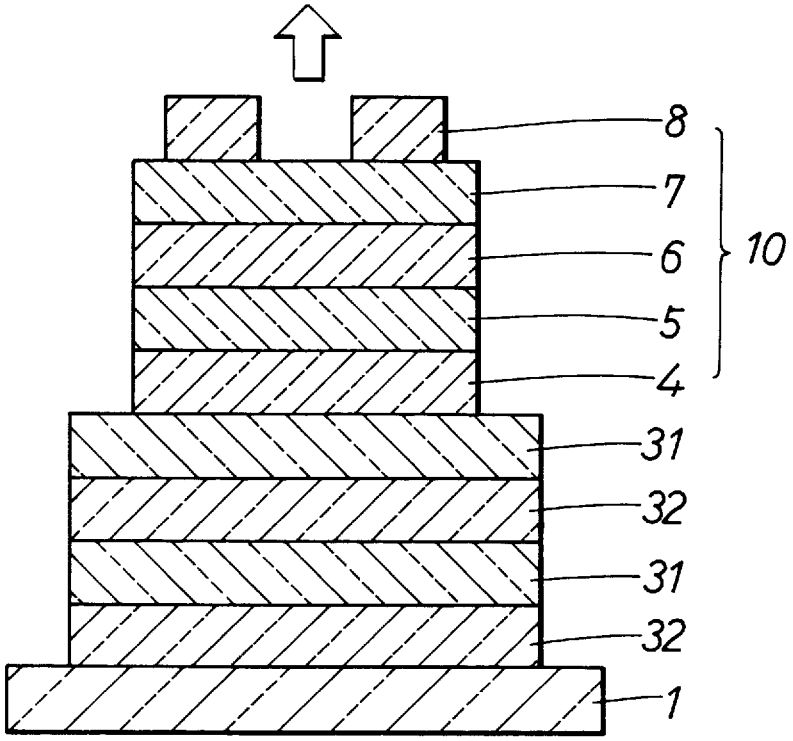
FIG. 8 is a schematic cross-sectional view of an EL device according to a fourth embodiment of the present invention.

Referring to FIG. 8, the EL device according to the fourth embodiment utilizes a multiple reflection layer comprising a lower refractive index insulating layer 31 and a higher refractive index insulating layer 32. The multilayered structure is formed at a thickness that a maximum reflection is achieved by any light having the wavelength of the light emitted from the luminescent layer. The thickness is determined by the well known relation of interference, i.e., by providing a thickness corresponding to the quarter wavelength multiplied by an integer number. For instance, in case the luminescent layer is a Mn-doped ZnS layer, the light emission has a wavelength of 580 nm. Thus, the quarter wavelength multiplied by an integer is a value sufficiently small as compared with the order of a micrometer. Accordingly, such a thickness can be realized by the layer thickness of the insulating substance.

As described in the fourth embodiment, the light reflecting plane which is not located between the electrodes of the EL element 10 not necessarily be a metallic material having a metallic luster. A material which causes light reflection is sufficient. Furthermore, since the lower refractive index insulating layer 31 and the higher refractive index insulating layer 32 are originally insulating layers, they do not electrically influence the EL element 10.

EXAMPLE 5

Figure 9:
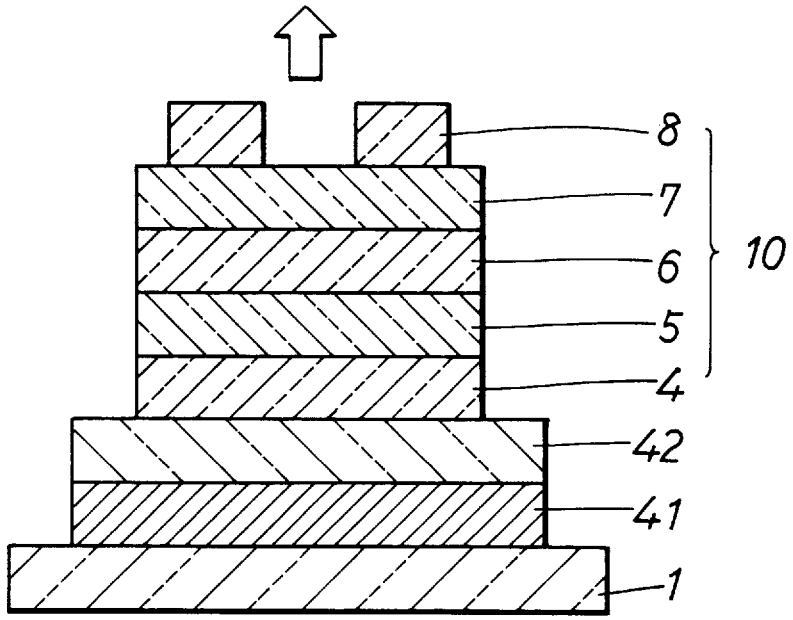
FIG. 9 is a schematic cross-sectional view of an EL device according to a fifth embodiment of the present invention.

As shown in FIG. 9, the EL device according to the fifth embodiment is a modification of the constitution described in Example 1. Referring to FIG. 9, an aluminum light reflecting plane 41 is used for the light reflecting plane 2, and the layer of the insulating material is provided with an anodic oxide film 42 of aluminum. This structure can be implemented by first forming an Al light reflecting plane 41 by evaporation and the like on the glass substrate 1 provided as the insulating substrate, and forming an oxide film 42 on the surface by means of anodic oxidation using the Al light reflecting plane 41 as the electrode. The oxide film 42 is provided at such a thickness that the light emitted from the luminescent layer 6 is maximally reflected. The thickness of the oxide film 42 can be easily controlled and determined by the quantity of current applied at the anodic oxidation. An EL element 10 is formed on the resulting anodic oxide film 42 thereafter.

Figure 10:
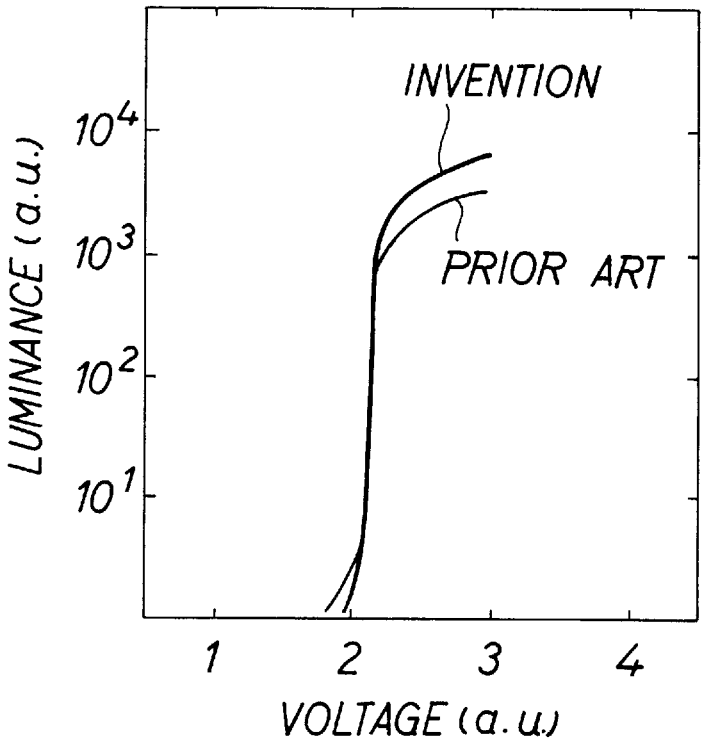
FIG. 10 is a characteristic diagram showing the relationship between a luminance and an applied voltage.

The emission luminance for a conventional EL device having no light reflecting plane and that for an EL device having the light reflecting plane according to the present invention are shown in FIG. 10. It can be seen therefrom that the EL device according to the present invention emits light at a luminance twice as large as that of a conventional device. This is in good agreement with the result expected by principle.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An electroluminescent device comprising:

an insulating substrate;

an electroluminescent element structure which has a pair of electrodes comprising a transparent first electrode disposed on an insulating substrate side and a transparent second electrode disposed on a light outgoing side, and a stack of layers comprising a transparent first insulating layer, a luminescent layer and a second transparent insulating layer all of which are interposed between said pair of electrodes, wherein said transparent first electrode has a pattern comprising a plurality of regions each isolated and insulated from each other and regions of said stack of layers interposed between said transparent first electrode and said transparent second electrode serve as light emitting regions;

a light reflecting film disposed on said insulating substrate, said light reflecting film being patterned so that said light reflecting film is placed only at a location corresponding to said light emitting regions; and a transparent insulating substance interposed between said transparent first electrode and said light reflecting film, wherein light which is emitted from said light emitting regions and travels toward said insulating substrate is reflected in a direction of said light outgoing side by said light reflecting film placed only at said location corresponding to said light emitting regions.

2. An electroluminescent device according to claim 1, wherein said insulating substance is a monolayer film of an insulating material, or a layered film consisting of a plurality of different types of insulating materials.

3. An electroluminescent device according to claim 2, wherein said insulating material is selected from the group consisting of SiON, SiN, $SiO_2$, $Ta_2O_3$, and $Al_2O_3$.

4. An electroluminescent device according to claim 1, wherein said light reflecting film is a metallic film having a reflectance of 50% or higher.

5. An electroluminescent device according to claim 4, wherein said metallic film is made of a metal selected from the group consisting of aluminum, silver, copper, gold, nickel, tantalum, tungsten, and molybdenum.

6. An electroluminescent device according to claim 4, wherein said metallic film is made of an aluminum alloy containing aluminum as the principal component.

7. An electroluminescent device according to claim 4, wherein said light reflecting film is made of an aluminum or an aluminum alloy containing aluminum as the principal component, which is formed at a film thickness of between 100 Å and 1,000 Å.

8. An electroluminescent device according to claim 1, wherein said film making up said light reflecting plane is a reflection enhancing film comprising a stacked film in which a lower refractive index transparent insulating layer and a higher refractive index transparent insulating layer are laminated alternately.

9. An electroluminescent device according to claim 1, wherein said film making up said light reflecting plane is of a substance capable of forming an anodic oxidation film, and said insulating substance is said anodic oxidation film or a layered film of said anodic oxidation film and an insulating film.

10. An electroluminescent device according to claim 1, wherein said insulating substance has a film thickness of between 0.01 $\mu$m and 5 $\mu$m.

11. An electroluminescent device according to claim 1, wherein said light reflecting film is smaller in area than each of said light emitting regions.

12. An electroluminescent device according to claim 1, wherein said transparent second electrode has a pattern comprising a plurality of regions each isolated and insulated from each other, said plurality of regions of said transparent first electrode are orthogonal to said plurality of regions of said transparent second electrode to form a matrix, said light reflecting film is formed on said insulating substrate so as to be placed only at intersections of said transparent first electrode and said transparent second electrode in said matrix.

* * * * *